US005106318A

United States Patent [19]

Endo et al.

[11] Patent Number: 5,106,318

[45] Date of Patent: Apr. 21, 1992

[54] BRANCH CIRCUIT-CONSTITUTING STRUCTURE

[75] Inventors: Takayoshi Endo; Sakai Yagi; Masanori Tsuji, all of Shizuoka, Japan

[73] Assignee: Yasaki Corporation, Tokyo, Japan

[21] Appl. No.: 716,874

[22] Filed: Jun. 18, 1991

[30] Foreign Application Priority Data

Jun. 27, 1990 [JP] Japan ..... 2-67255[U]

[51] Int. Cl.[5] ..... H01R 29/00

[52] U.S. Cl. ..... 439/189; 439/507; 439/509; 439/512

[58] Field of Search ..... 439/52, 189, 507, 509, 439/512, 513

[56] References Cited

U.S. PATENT DOCUMENTS

| | | | |
|---|---|---|---|
| 4,089,576 | 5/1978 | Barchet | 439/507 |
| 4,487,464 | 12/1984 | Kirschenbaum | 439/507 |
| 4,676,566 | 6/1987 | Abe | 439/507 |
| 4,871,323 | 10/1989 | Ohsumi | 439/509 |
| 4,927,787 | 5/1990 | Patel | 439/189 |
| 4,952,155 | 8/1990 | Kuzuno et al. | 439/189 |
| 5,000,699 | 3/1991 | Nadin | 439/189 |
| 5,007,888 | 4/1991 | Goutiere | 439/189 |

FOREIGN PATENT DOCUMENTS

| | | |
|---|---|---|
| 61-277180 | 12/1986 | Japan . |
| 2-16541 | 5/1990 | Japan . |

*Primary Examiner*—Paula A. Bradley
*Attorney, Agent, or Firm*—Sughrue, Mion, Zinn, Macpeak & Seas

[57] ABSTRACT

A branch circuit constituting structure comprises, a housing including a plurality of juxtaposed terminal chambers and through holes formed respectively through a side wall thereof and partition walls each provided between respective adjacent ones of the terminal receiving chambers, metal terminals each having a wire connection portion and an electrical contact portion which is open at opposite sides of a terminal receptive portion of the electrical contact portion and a side of said wire connection portion, and a short-circuit member insertable into the housing through the through holes.

3 Claims, 3 Drawing Sheets

BRANCH CIRCUIT-CONSTITUTING STRUCTURE

BACKGROUND OF THE INVENTION

This invention relates to a branch circuit-constituting structure used chiefly to form a branch circuit in wire harnesses for an automobile.

Referring to FIG. 7, a branch terminal b having tab-like male contact portions $b_1$ is inserted into one side of a housing a having a plurality of terminal receiving chambers al, so that the tab-like male contact portions $b_1$ are received respectively in the terminal receiving chambers $a_1$. In this condition, a lid plate c is closed to fix the branch terminal. A plurality of female metal terminals d each having an electric wire w fixed thereto are inserted respectively into the terminal receiving chambers al, and are connected respectively to the tab-like male contact portions bl disposed in opposed relation thereto. In this manner, a branch circuit is formed through the branch terminal b.

In the above prior art, the special branch terminal is needed, and the housing is required to have a special mounting construction for the attachment of the branch terminal thereto.

SUMMARY OF THE INVENTION

In view of the above, it is an object of this invention to provide a branch circuit-constituting structure which omits such a branch terminal so as to simplify the overall construction.

The above object has been achieved by a branch circuit-constituting structure characterized by the provision of a housing which has a plurality of juxtaposed terminal receiving chambers and has through holes formed respectively through a side wall thereof and partition walls each provided between respective adjacent ones of said terminal receiving chambers; metal terminals each having a wire connection portion and an electrical contact portion which is open at opposite sides of a terminal receptive portion of said electrical contact portion; and a short-circuit metal member insertable into said housing through said through holes; said short-circuit metal member being inserted in said terminal receptive portions from the sides thereof so as to connect said plurality of metal terminals together.

DETAILED DESCRIPTION OF THE PREFERRED EMBODIMENTS

Figure 1:
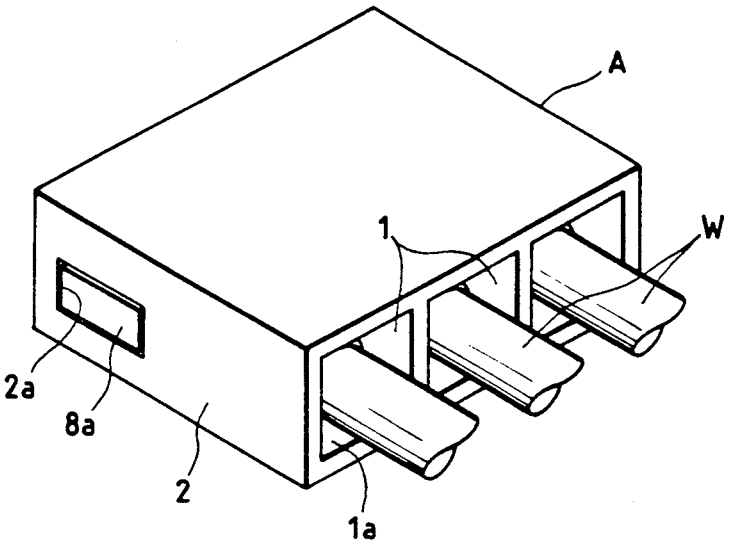
FIG. 1 is a perspective view of one preferred embodiment of the present invention.
Figure 2:
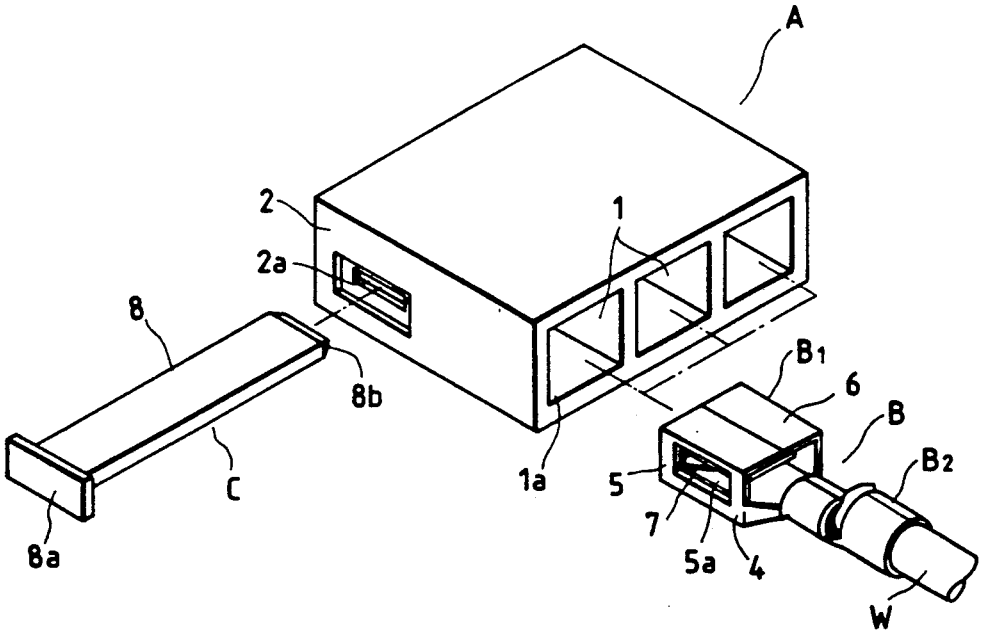
FIG. 2 is an exploded perspective view of the above embodiment.
Figure 3:
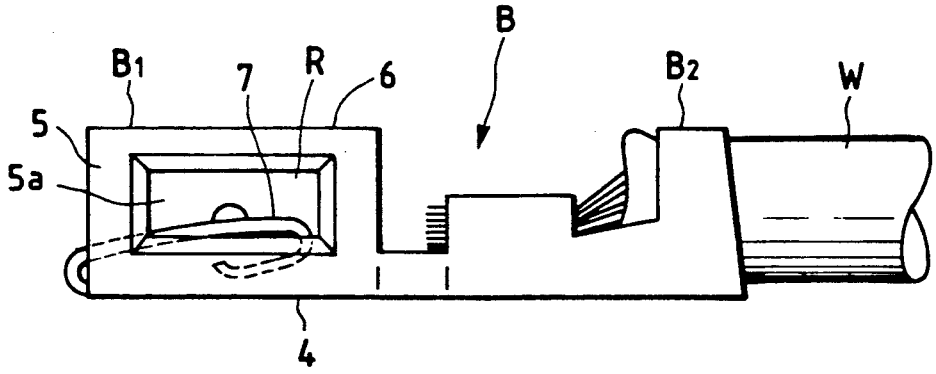
FIG. 3 is a side-elevational view of a metal terminal.

In FIGS. 1 to 3, reference characters A, B and C denote a housing of a synthetic resin, a metal terminal, a short-circuit metal member, respectively.

The housing A has a plurality of juxtaposed terminal receiving chambers 1 each having an opening 1*a* at one end thereof. A through hole 2*a* is formed through one side wall 2 of the housing, and through holes 3*a* are formed through partition walls 3 of the housing, respectively (see FIG. 6). The through holes 2*a* and 3*a* are aligned with one another in a direction perpendicular to the terminal receiving chambers 1.

The metal terminal B has an electrical contact portion B1 and a wire connection portion B2. The electrical contact portion B1 has a bottom plate portion 4, and side walls 5 upstandingly extending respectively form the opposite sides of this bottom plate portion. The distal portions of the side walls 5 are bent inwardly to form a top plate portion 6. An extension portion of the bottom plate portion 4 is bent or folded back to form a resilient contact piece 7 disposed in opposed relation to the top plate portion 6. An opening 5*a* is formed through each of the side walls 5, and the openings 5*a* are in registry with a terminal receptive portion R formed by the resilient contact piece 7 and the top plate portion 6.

The short-circuit metal member C is made of a electrically-conductive material, and has a short-circuit plate portion 8 having an insertion end 8*b* chamfered into a tapered shape. An engaging head 8*a* is formed on the other end of the short-circuit plate portion 8. The short-circuit plate portion 8 is inserted into the terminal receptive portion R through the through holes 2*a* and 3*a*, and the engaging head 8*a* is engaged in the through hole 2*a* in the side wall 2.

Figure 4:
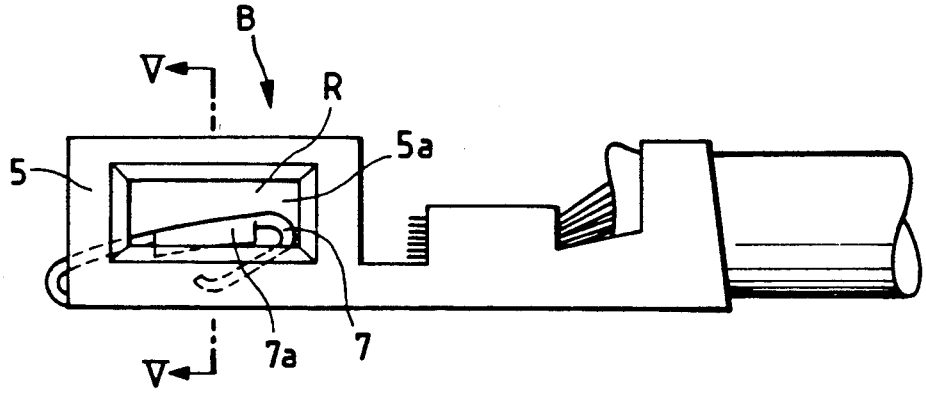
FIG. 4 is a side-elevational view of a modified metal terminal.
Figure 5:
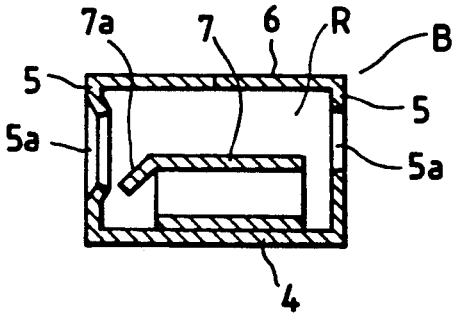
FIG. 5 is a cross-sectional view taken along the line V—V of FIG. 4.

In an embodiment shown in FIGS. 4 and 5, a tapered contact guide portion 7*a* for guiding the short-circuit metal member C is formed on one side of the resilient contact piece 7 of the metal terminal B.

In use, the metal terminals B each having an electric wire w connected thereto are inserted respectively into the terminal receiving chambers 1 through the respective openings la, and the short-circuit plate portion 8 of the short-circuit metal member C is inserted through the terminal receptive portions R of the metal terminals B through the through holes 2*a* and 3*a*, and is held in contact with the resilient contact pieces 7, thereby forming a branch circuit between one selected wire w and other wires w.

Figure 6:
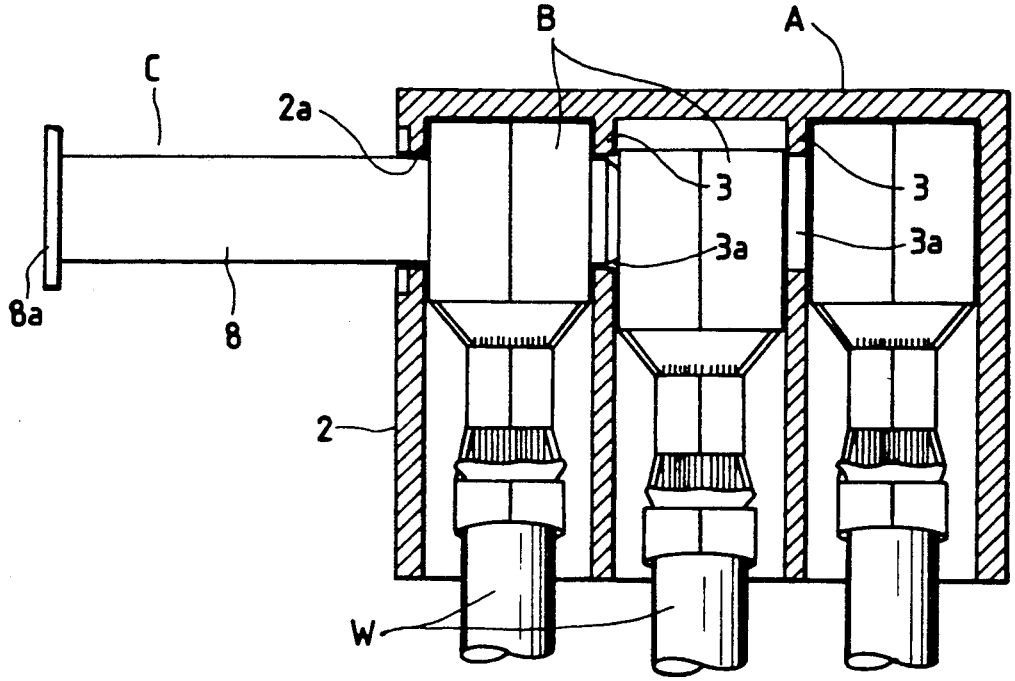
FIG. 6 is a cross-sectional view showing the process of insertion of a short-circuit metal member.
Figure 7:
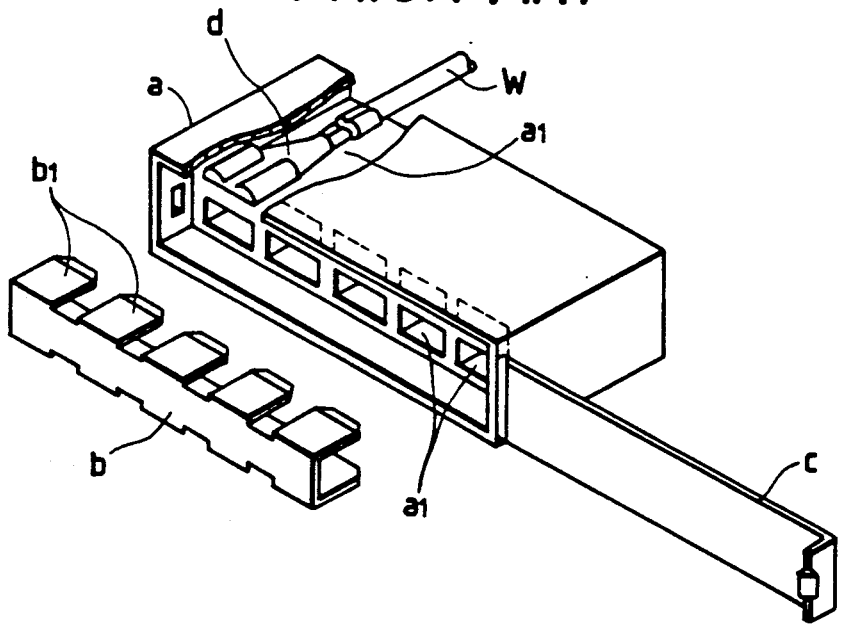
FIG. 7 PRIOR ART
FIG. 7 is a perspective view of the prior art.

If one or some of the plurality of metal terminals B are not sufficiently inserted into the mating terminal receiving chambers 1, the short-circuit metal member 8 can not be inserted fully as shown in FIG. 6, thus detecting such insufficient insertion of the metal terminal B.

As described above, in the present invention, the branch circuit-constituting structure comprises the housing which has a plurality of juxtaposed terminal receiving chambers and has the through holes formed respectively through the side wall thereof and the partition walls each provided between respective adjacent ones of the terminal receiving chambers; the metal terminals each having the wire connection portion and the electrical contact portion which is open at opposite sides of the terminal receptive portion of the electrical contact portion; and the short-circuit metal member insertable into the housing through the through holes; the short-circuit metal member being inserted in the terminal receptive portions from the sides thereof so as to connect the plurality of metal terminals together. With this construction, the branch circuit can be easily and rapidly provided in an electrical wiring made, for example, of wire harnesses used in an automobile.

WHAT IS CLAIMED IS:

1. A branch circuit constituting structure comprising:

a housing including a plurality of juxtaposed terminal chambers and through holes formed respectively through a side wall thereof and partition walls each provided between respective adjacent ones of said terminal receiving chambers;

metal terminals each having a wire connection portion and an electrical contact portion which is open at opposite sides of a terminal receptive portion of said electrical contact portion and a side of said wire connection portion; and a short-circuit member insertable into said housing through said through holes.

2. A branch circuit constituting structure as claim 1, wherein said through holes are aligned with one another in a direction perpendicular to said terminal receiving chambers.

3. A branch circuit constituting structure as claimed in claim 1, said short circuit metal member is made of a electrically conductive material, and has a short circuit plate portion having an insertion end chamfered into a tapered shape.

* * * * *